United States Patent [19]

Castellano

[11] Patent Number: 5,014,291

[45] Date of Patent: May 7, 1991

[54] DEVICE FOR AMPLIFICATION OF X-RAYS

[76] Inventor: Nicola Castellano, 32-3, Via G.B. D'Albertis, I-16148 Genova, Italy

[21] Appl. No.: 337,421

[22] Filed: Apr. 13, 1989

[51] Int. Cl.[5] ..... G21K 1/00

[52] U.S. Cl. ..... 378/145; 378/84; 378/85

[58] Field of Search ..... 378/70, 71, 84, 85, 378/119, 145, 147, 122

[56] References Cited

U.S. PATENT DOCUMENTS

| | | | |
|---|---|---|---|
| 2,533,859 | 12/1950 | Wideröe | 378/138 |
| 2,759,106 | 8/1956 | Wolter | 378/145 |
| 2,766,385 | 10/1956 | Herrnring et al. | 378/145 |
| 3,826,996 | 7/1974 | Jaegle et al. | 378/119 |
| 3,970,884 | 7/1976 | Golden | 378/122 |
| 4,122,342 | 10/1978 | Vali et al. | 378/119 |
| 4,143,275 | 3/1979 | Mallozzi et al. | 378/70 |
| 4,596,030 | 6/1986 | Herziger et al. | 378/122 |
| 4,698,833 | 10/1987 | Keem et al. | 378/85 |
| 4,715,054 | 12/1987 | Kato | 378/122 |
| 4,757,524 | 7/1988 | Laul | 378/122 |
| 4,845,371 | 7/1989 | Stieber | 378/137 |

FOREIGN PATENT DOCUMENTS

| | | | |
|---|---|---|---|
| 2115400 | 5/1987 | Japan | 378/145 |
| 8801428 | 2/1988 | World Int. Prop. O. | 378/147 |

*Primary Examiner*—Carolyn E. Fields
*Assistant Examiner*—David P. Porta
*Attorney, Agent, or Firm*—Larson and Taylor

[57] ABSTRACT

A device for the amplification of X-ray intensity: X-rays originating from a conventional source are made to reflect several times onto a metallic surface. At the moment of each reflection or the like the incident X-rays provoke emission of other X-rays from the reflective surface. The X-rays emitted during each reflection reinforce the intensity of the reflected ray, amplifying thus the intensity. To obtain this, the metallic reflective surface is maintained in an excited state suitable for X-ray emission. The device is made up of two concentric metal rings, to which is applied a high voltage. In the space between the metal rings an exciting gas is introduced, that, due to the strong potential difference applied, excites the metal surfaces of the rings.

11 Claims, 1 Drawing Sheet

DEVICE FOR AMPLIFICATION OF X-RAYS

BACKGROUND AND SUMMARY OF THE INVENTION

This invention refers to a method for X-ray amplification and to an applicance for putting into practice of same.

The purpose of the invention is a method for amplification of X-ray intensity, and also a device for practicing the same method, that by using the physical characteristics of the X-rays themselves, can lead to the realization of an appliance which is efficient and reliable, not costly, which does not require much space and is of relatively simple construction. The invention solves this problem by taking the primary X-rays obtained from a convention X-ray tube and reflecting them repeatedly onto an electrode, made of suitable metallic material, and maintained at a certain potential and in certain conditions of excitation that allow the incident rays not only to reflect themselves, but also induction of X-ray emission from the reflective material. Part of the rays generated in this manner join the reflected primary rays amplifying the intensity.

To be able to considerably reinforce the intensity of the incidental radiation, the reflection-emission operation must be repeated several times in succession.

To put this method into practice, the invention provides for an amplifying device consisting of two concentric metal rings, of metallic material suitable for the purpose, between which a suitable exciting gas, such as Xexon, is introduced and to which are applied a measure of potential difference that induces acceleration of the particles of the exciting gas so that they hit the surfaces of the metal rings, bringing them into a state of excitation favourable to the emission of X-rays.

Concerning the invention it is appropriate to place the said amplifying device inside a container that can be made vacuum, made for example of glass. The device may also be made to function without the emission of gas, by applying an appropriate electrical potential between the two electrodes. Furthermore, the device is provided with entrance and exit channels positioned substantially tangent to the inside metallic ring, at such an angle, that the incidental X-rays through the entrance channel leave by the exit channel after several reflections.

The invention has other characteristics which further improve the above mentioned device.

BRIEF DESCRIPTION OF THE DRAWINGS

The particular features of the invention and the advantages deriving therefrom as well as the theory on which the method is based will be examined in greater detail from the description of a preferred embodiment. In the drawings.

DESCRIPTION OF THE PREFERRED EMBODIMENT OF THE INVENTION

Figure 1:
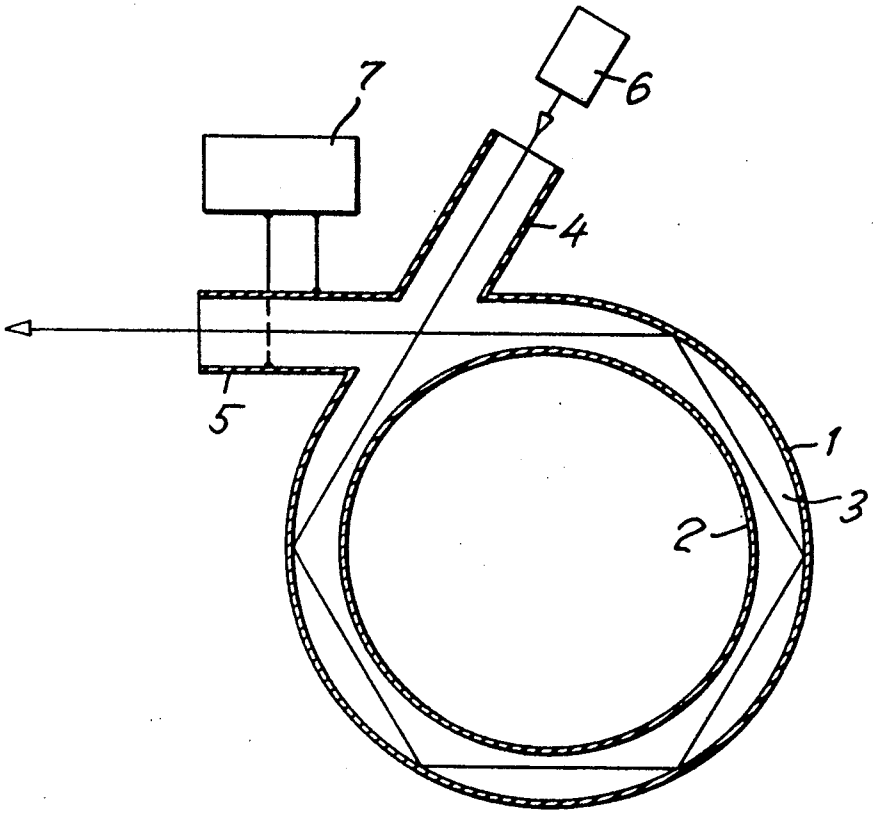
FIG. 1 is a diagrammatic of a top view of the device according to the invention.

In the following description, and in the claims, the term "X-ray reflection" has been used to indicate the phenomenon of induced emission of X-rays by an electrode of "reflection". It will be noted, however, that in a purely technical sense this term is not perfectly accurate, as it regards phenomena of diffraction, diffusion, scattering, etc. The term "reflection" has, nevertheless, been adopted as (a) its significance is immediately comprehensible, and (b) on the practical side, for the purpose for which the invention is intended, the effect that ensues is identical.

The method in conformity with the invention foresees firstly, exploitation of X-ray diffraction on the crystal lattice, so that the incidental X-rays of fixed frequency are reflected at a characteristic angle dependent on both the frequency of the incidental rays on the structural properties of the material making up the reflective surfaces.

Secondly, advantage is taken of the strength of the incidental X-rays to induce, in a target material, an emission of X-rays (of equal or greater wave length). A part of these X-rays will most certainly be emitted in the direction of the reflected rays increasing the overall intensity.

The reflective surface, furthermore, is maintained in a suitably excited state for emission of X-rays. By virtue of this measure, the assumption is that the incidental X-rays induce emission of new X-rays through the target surface, without substantial loss of intensity, becoming fortified following reflection, due to the superposition of the rays emitted by induction in the direction of reflection. A preferred embodiment of an amplifying device for the practice of this method consists, basically, of two circular metal rings 1, 2 arranged concentrically so as to create a space or channel 3 between them. These circular rings 1, 2 can be made of any metallic material suitable, to reflect or to emit X-rays, and to the frequency of the incidental rays, to obtain the desired effect of amplification. This is achieved if the two circular rings are of a metal having an atomic number equal or lower to that of the anti-cathode of the tube producing the primary X-rays.

For example, for one incidental X-ray obtained from a tungsten anti-cathode, the circular rings 1, 2 can be made, advantageously, of silver or tin or antimony, because these elements are of an atomic number inferior to that of tungsten, and also because their electronic levels are favourable to induced X-rays.

In the space 3, there is an entrance channel 4, and an exit channel 5, both basically tangent to the inside circular rings 2, and at a proper angle so that the incidental X-rays, coming from the source 6, penetrate the space 3, through the entrance channel 4, and after several reflections leave the aforesaid space through the exit channel 5.

The complete amplifying device is housed in a casing (not shown), such as a glass container, which can be emptied of air.

In order to put the reflective surface 1, into a state of excitation it is sufficient to apply an appropriate difference of potential to the metallic rings 1, 2. Thus each metallic ring 1, 2 can be connected respectively to one pole of an electric mean 7, for example a suitable power supply. The applied potential difference must be superior to the highest typical potential of ionization of the metallic material of the rings 1, 2, to ensure a sufficient excitation of the electronic states in the metallic rings 1, 2.

Nevertheless, to increase the excitation of the reflective surface, i.e., of the metallic ring 1, thus obtaining a greater amplification of the incident X-rays, an exciting gas can be introduced inside the space 3. The atomic number of the exciting gas must be higher than the atomic number of the metallic material of the rings 1, 2. As an exciting gas it is possible to use for example Xenon at pressures which vary i.e., from $10^{-3}$ to $10^{-5}$ mbar. It is assumed that the difference of potential applied, for example, 50 kvolts, ionizes the exciting gas accelerating the ions and electrons against the metal rings 1, 2 and inducing, in particular the circular ring 1 in a state of excitation fitting for X-ray emission. In this particular case the metallic rings 1, 2 work also as accelerating electrodes for the exciting gas particles. It is presumed that this state of excitation of the reflective metal also permits induction of X-ray emission without causing virtually any excessive weakening of the incidental X-rays and permitting therefore their amplification, as the electrons of the most internal strata have been blown up to a superior energy level obtaining an inversion of the electonic ambient favorable induction of new X-rays.

Realization of the reflective and emission surfaces in the form of circular metallic rings (best if buffed to a high lustre) means that the problem, related to the precise direction of the subsequent surfaces of reflection and emission, is eliminated, rendering construction of the device, pertinent to the invention, particularly simple and efficaceous. In fact, because of the feature of the geometrical circular form of the external ring, with any angle of incidence whatsoever the reflection will be similar. According to their angle of incidence, the primary X-rays can also fall on and be reflected by the inner surface of the inner metallic ring 2.

The dimensions of the X-ray amplifier, according to this illustrative example, must be established so that the number of reflections and emissions are sufficient to ensure a good amplification of primary ray intensity, with possible exploitation of any reflections on inside ring 2.

Using, for example, circular rings of silver (or silver coloured metal), with the primary rays of inferior wave length to lambda=0.561 Å typical of silver, emitted by an anticathode of tungsten, a reflection angle equal to approximately 3°55′, typical both for such a wavelength as well as the silver lattice (d=4.077 Å), therefore along one circumference about 46 subsequent reflections can be observed.

Figure 2:
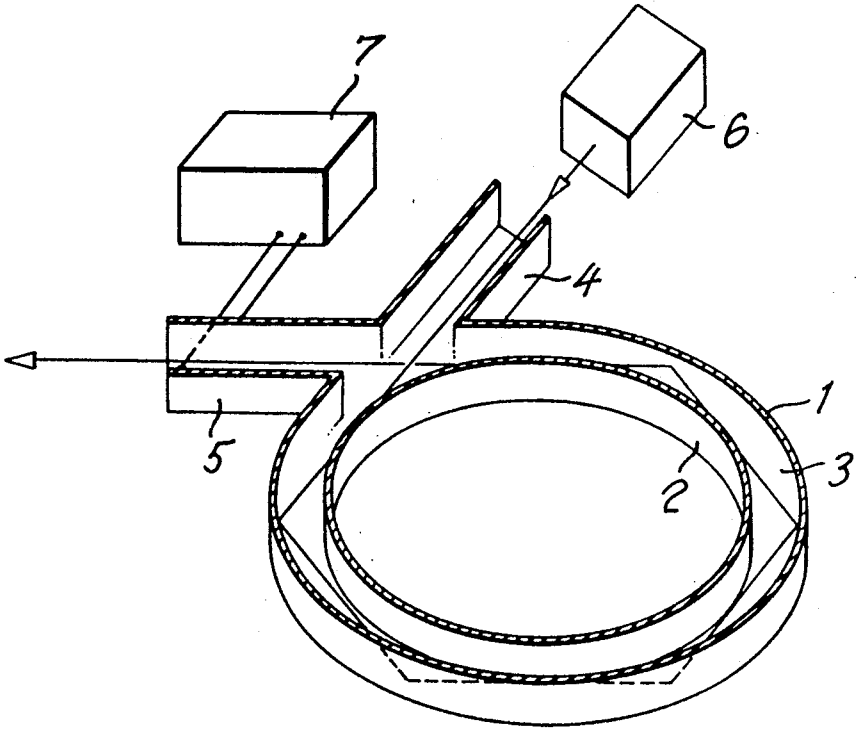
FIG. 2 is a perspective view of the device of FIG. 1.

A practical embodiment for realization of the device according to the invention is made up of a glass ring fitted with two tangential channels for entrance and exit (as per FIGS. 1 and 2 in the attached drawing), housing inside it the two circular electrodes 1, 2 made from silvered tin and distant one from the other 2 cms, with V=50 kv. The outside diameter of the glass ring is 32.5 cms. and an inside diameter of 29.5 cms, it is closed at the two extremities, is vacuum and is filled with Xenon. In a further improvement of the invention, the two circular concentric rings 1, 2 can be made of any element suitable for X-rays emission, having in all cases either the same atomic number or a lower atomic number than that of the metallic anti-cathode of the tube producing the primary X-rays.

Preferably the surfaces of the concentric rings or electrodes 1, 2 are buffed to a higher lustre in order to ensure very high reflections coefficients.

What is claimed is:

1. An X-ray amplifying device comprising means defining an annular space; an exciting gas in said annular space; internal and external circular concentric rings of suitable metallic material circumscribing said annular space and spaced apart to form a channel between them, at least one of said rings forming an X-ray reflection electrode, an entrance and an exit port in said channel, means for applying a suitable difference of electrical potential to the said metallic rings so as to bring them into an excited state favourable to X-ray emission, a suitable X-ray source providing a primary X-ray beam directed so as to enter said entrance port striking against said reflection electrode so as to be reflected at least once before leaving said channel through said exit port so as to cause the X-rays, emitted from the reflection electrode by induced emission, to be superimposed on the X-ray reflected by said reflection electrode thus inceasing the intensity of the X-ray beam leaving the device.

2. A device according to claim 1, in which the applied difference of potential is sufficient to accelerate particles of the exciting gas such that they, in turn, excite the metal rings favourably for X-ray emission.

3. A device according to claim 1, said entrance port and exit port each placed substantially tangent to the said channel between the internal and external metallic rings and at such an angle that after one or more reflections of the incidental rays through entrance port, ray emission takes place through the exit port.

4. A device according to claim 3, in which the concentric metallic rings and the entrance and exit channels are housed in a container that can be emptied of air.

5. A device according to claim 1, in which the external circular metallic ring constitutes part of both a reflective surface and an anticathode for induced emission of X-rays.

6. A device according to claim 1 in which the exciting gas is made up of Xenon or other gas of higher atomic number than that of the metallic electrodes and the difference of potential applied to the metallic rings is of a potential superior to the highest typical potential of ionization of the metal of the metallic-rings.

7. A device according to claim 1, in which, when using a conventional source in tungsten for the primary X-rays, the concentric metallic rings are made of silver or of a silver plated metal, or of tin or other metal of an elevated atomic number, but in any case lower or equal to that of tungsten.

8. A device according to claim 1, in which the two circular concentric electrodes are of metals, of any element suitable for X-ray production, which have either the same atomic number or a lower atomic number than that of the metal of the anticathode producer of the primary X-rays.

9. An X-ray amplifying device comprising means defining an annular space; an exciting gas in said annular space; internal and external circular concentric rings of suitable metallic material circumscribing said annular space and spaced apart to form a channel between them, means for applying a suitable difference of electrical potential to the said metallic rings so as to bring them into an excited state favourable to X-ray emission, wherein the applied difference of potential is sufficient to accelerate particles of the exciting gas such that they, in turn, excite the metal rings favourably for X-ray emission.

10. An X-ray amplifying device comprising means defining an annular space; an exciting gas in said annular space; internal and external circular concentric rings of suitable metallic material circumscribing said annular space and spaced apart to form a channel between them, means for applying a suitable difference of electrical potential to the said metallic rings so as to bring them into an excited state favourable to X-ray. emission, and further comprising an entrance channel and an exit channel, each placed substantially tangent to the said channel between the internal and external metallic rings and at such an angle that after one or more reflections of incidental rays through the entrance channel, ray emission takes place through the exit channel.

11. A device according to claim 10, in which the concentric metallic rings and the entrance and exit channels are housed in a container that can be emptied of air.

* * * * *